US005680890A

United States Patent [19]

Allsopp

[11] Patent Number: 5,680,890

[45] **Date of Patent: *Oct. 28, 1997**

[54] PLEATED BLIND

[75] Inventor: Reginald Charles Allsopp, Stockport, England

[73] Assignee: Louver-Lite Ltd., Cheshire, England

[ * ] Notice: The term of this patent shall not extend beyond the expiration date of Pat. No. 5,551,500.

[21] Appl. No.: 675,012

[22] Filed: Jul. 3, 1996

Related U.S. Application Data

[63] Continuation of Ser. No. 247,769, May 23, 1994, Pat. No. 5,551,500.

[51] Int. Cl.[6] ..... E06B 3/48

[52] U.S. Cl. ..... 160/84.04; 160/84.01

[58] Field of Search ..... 160/84.01–84.11, 160/348, 344, 330

[56] References Cited

U.S. PATENT DOCUMENTS

| | | |
|---|---|---|
| 4,535,828 | 8/1985 | Brockhaus . |
| 4,544,011 | 10/1985 | Sawamura . |
| 4,685,986 | 8/1987 | Anderson . |
| 4,694,545 | 9/1987 | Dennis . |
| 4,763,713 | 8/1988 | Kraus . |
| 4,880,044 | 11/1989 | Judkins . |
| 4,884,612 | 12/1989 | Schnebly et al. . |
| 5,139,069 | 8/1992 | Hong . |
| 5,551,500 | 9/1996 | Allsopp . |

FOREIGN PATENT DOCUMENTS

| | | |
|---|---|---|
| 504127 | 4/1939 | United Kingdom . |
| 2182968 | 5/1987 | United Kingdom . |
| 2221944 | 2/1990 | United Kingdom . |
| 2236551 | 4/1991 | United Kingdom . |
| WO89/12415 | 12/1989 | WIPO . |

*Primary Examiner*—Blair Johnson

*Attorney, Agent, or Firm*—Dennison, Meserole, Pollack & Scheiner

[57] ABSTRACT

The invention provides an improved pleated blind in which the distance between alternate folds is constrained so as to present a more pleasing appearance when the blind is unfolded. In one embodiment of the invention there is provided a connecting member 50 which is flexibly connected to alternate fold lines of a blind of sheet element 16. The flexible securement is provided by a plurality of I-section tags 52, each having a center section 54 and cross pieces 56, 58 at each end thereof.

5 Claims, 2 Drawing Sheets

PLEATED BLIND

This is a continuation of application Ser. No. 08/247,769, filed May 23, 1994, U.S. Pat. No. 5,551,500.

This invention relates to an improved pleated blind in which the folding of the blind is generally uniform when it is extended over the full area to be covered by the blind.

BACKGROUND OF THE INVENTION

A pleated blind for an opening generally comprises a top rail, a bottom rail and a web of a fabric (or other foldable material) arranged between them. The blind is normally arranged so that the fabric is folded in a concertina fashion between the top rail and bottom rail. In use, the bottom rail is displaceable towards and away from the top rail. This in turn causes the folded fabric to be either collapsed or extended. In the pleated blind the fabric is adapted to retain its folds or pleats even when the blind is in an extended condition.

One problem with such an arrangement is that, when the blind is extended, the weight of the fabric will tend to pull the folds or pleats at the top of the blind comparatively straight whilst the folds at the bottom of the blind will remain in close proximity to the bottom rail.

Thus unless the fabric is maintained tensioned between the top and bottom rails it will have a tendency to hang unevenly and otherwise present an unpleasing appearance. Particular problems arise if the blind is not of a regular, rectangular shape. For example, for some applications it may be desirable to employ a pleated blind which is generally triangular or circular. However, such blinds will only conform to the required shape if the pleats are uniformly spaced when the fabric is extended.

DESCRIPTION OF THE PRIOR ART

Thus, particular problems arise for pleated blinds which are intended to retain their folds/pleats even when in their extended condition. The difficulties are not so acute for blinds of the Roman type, such as described in GB-A-2221944, of Graber Industries, Inc. for example. This is because such blinds are generally formed by a series of loops or pockets secured together at horizontal seams. The presence of such seams prevents the blind from sagging and losing its shape.

Also, to some extent the problems discussed above are not so severe for so called honeycomb blinds. Such blinds comprise two continuous lengths of pleated materials secured together intermediate the pleats. In this way each length of pleated material defines a side of a honeycomb structure. Securing the materials together in this way has an advantage in that it confers some form-stability to the blind. However, honeycomb blinds can be relatively costly and complicated to manufacture.

Examples of honeycomb blinds are given in U.S. Pat. No. 4,685,986 of Anderson, GB-A 2182968 of Hunter Douglas Industries BV and GB-A-2236551 of Graber Industries Inc. Also, a honeycomb blind, which has variable light-filtering effects, is disclosed in WO89/12415 of Schnebly et al. In this case the blind is constructed so as to have stiffened cambered slats which extend rearwardly of a front pleated covering. In use the slats may be urged towards one another to form a honeycomb type structure which has desirable light-reflecting and room-darkening characteristics. However, this arrangement may be more elaborate than is necessary for many applications.

U.S. Pat. No. 4,880,044 of Judkins, discloses spacer devices for controlling the spacing between pleats in a blind or shade of the type which comprises a single web of folded material arranged between a rail pair. The spacer device is formed of a thin piece of material of predetermined length. In some embodiments the material is a cord and has loops extending from it. The cord or rod which is used to control opening and closing of the blind is threaded through the loops on the spacer device. The spacer device is arranged so that loops are presented between at least some adjacent pleats of the blind fabric. The loops help to constrain unfolding of the blind and to support part of the weight of the blind to thereby maintain pleats in the blind even when in its expanded condition.

However, a disadvantage of the above system is that it could be troublesome to construct, particularly to thread the pull control cord or rod through the appropriate loops in the spacer device.

Other prior system's for constraining unfolding of a fabric blind involve glueing the fabric to a support at a fold line of the fabric. However, for many applications adhesives can be unsatisfactory since they can rapidly dry out and lose their adhesive properties when exposed to high temperatures in windows etc.

It would be advantageous to provide an improved pleated blind in which the unfolding or hanging of the blind is regularised with respect to spacing between folds.

SUMMARY OF THE INVENTION

The invention provides an improved pleated blind having at least two rails and a flexible sheet element, said flexible sheet element being arranged between said at least two rails, said flexible sheet element having a plurality of fold lines so that the element can be folded between the rails when they are displaced towards one another, the improvement comprising at least one flexible connecting member disposed between the two rails, the member being flexibly secured to the flexible sheet element at or adjacent to one or more alternate fold lines such that the unfolding of the element is constrained by the connecting member to a predefined maximum spacing between adjacent fold lines.

The connecting member is attached flexibly to the element so that some "play" is possible. This arrangement permits the flexible element to move and fold more freely when the blind is contracted or extended.

Advantageously the or each flexible connecting member is a length of material such as a ribbon or cord, disposed at least between the two rails. Preferably the attachment points for securement of the flexible sheet element to the connecting member are equidistantly spaced along the length of the member such that the folds in the sheet element will be similarly equidistantly constrained.

In some embodiments, the flexible connecting member, such as cord, may be provided with a plurality of loops arranged to be releasably engagable with the flexible sheet element at or adjacent to alternate fold lines of the element. Releasable securement of the flexible element to the connecting member is desirable in that it permits adjustment to be made where required. Additionally, if the connecting member is damaged, or requires removal for maintenance purposes, this can be accomplished easily and without major disruption.

In some embodiments the loops are integral with the flexible connecting member. For example, in the case where the member is a braided cord they may be attached to the cord during manufacture thereof, the loops being inserted between the cords separate fibres during a weaving process.

In most preferred embodiments the flexible connecting member is flexibly secured at or adjacent to a fold line of a flexible sheet element by a submember which comprises a shank and a projection at either end of the shank. The sheet element and connecting member are suitably provided with aligned apertures to accommodate the shank of the submember. In this way the sheet element and connecting member are retained between the spaced ends of the submember.

Preferably a submember is constructed so that at least one of its projections is resiliently deformable. In this way the projection may be deformed so that it is capable of being inserted into small apertures in the sheet element and connecting member. The deformed projection will subsequently extend or expand to engage the sheet element/connecting member.

In this regard, the submember is preferably constructed from a resiliently deformable plastics material.

In preferred embodiments the submember has at least one generally thin, elongate projection. This may comprise a wing extending laterally from a or two sides of a shank. In use, a projection may be arranged to lie generally on a fold line of a pleated blind. This is desirable because such a projection need not distort the shape of the blind. In this regard it is also preferred that the flexible sheet element be provided with a submember receiving aperture on one or more of its fold lines.

In such embodiments, in use, a projection of the submember will be located on the face of the blind which is to be visible to the user (the "front" face). The flexible connecting member will be located on the opposite or rear face. Use of a submember having a narrow projection is advantageous in that it reduces visibility of the submember from the front face of the blind.

Preferably the submember is constructed from a material which does not enhance its visibility when in use on a blind. In this regard, most preferably the submember is constructed from a generally transparent plastic.

The second projection of the submember, which engages the flexible connecting member, may be the same or different from the first projection.

In some preferred embodiments the submember is in the form of an I-section tag having an elongate shank and an elongate projection at either end.

It will be appreciated that, as is the case with conventional pleated blinds, the present blinds will typically incorporate mechanisms for raising and lowering the bottom rail to control opening and closing of the blind. Such mechanisms are known in the art. They generally incorporate a rod or cord which is threaded through a series of aligned apertures spaced along the length of the blind sheet element. The rod or cord will be at least partially visible from the front face of the blind. In advantageous embodiments of the invention the flexible connecting member is arranged, at the rear face of the blind, alongside the cord/rod of the pull mechanism. In this way the cord or rod may shield the flexible connecting member from view.

The invention will be described further by way of example with reference to the accompanying drawings in which:

DESCRIPTION OF THE PREFERRED EMBODIMENTS

Figure 1:
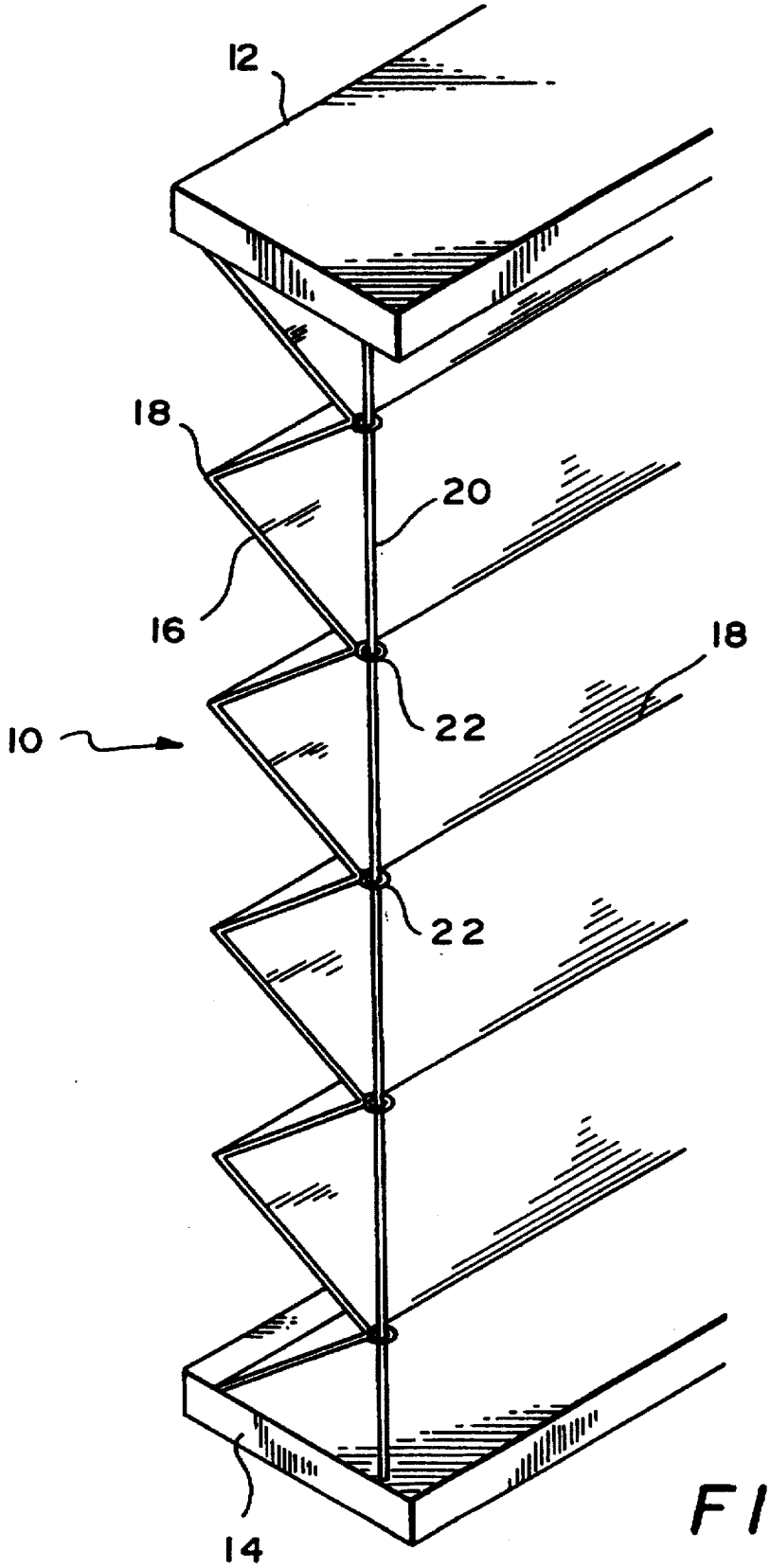
FIG. 1 is a perspective end view of a first embodiment.

Referring to FIG. 1, a first embodiment of the invention provides an improved pleated blind referred to generally by the reference numeral 10 and having a top rail 12 and a bottom rail 14. The bottom rail 14 is arranged to be displaceable by displacement means (not shown) between a lowered position, in which it is spaced from the top rail 12, and a raised position in which it is substantially adjacent to the top rail 12. The figure shows the rail 14 in its lowered configuration for clarity in relation to the overall blind assembly 10.

A flexible sheet element 16, is secured at each end to the top rail 12 and to the bottom rail 14. The flexible sheet element 16 comprises a single web of foldable material, suitably of a textile or similar fabric. The web may comprise several portions of fabric secured together at their ends, or perhaps laminated together at adjacent faces.

The flexible sheet element 16 is provided with a plurality of transversely extending pleats or fold lines 18 such that the element can be folded in a concertina-like fashion between the top and bottom rails. The sheet element 16 is adapted to retain the fold lines 18 when the top and bottom rails 12, 14 are spaced apart. These features are found in known pleated blind assemblies.

In use with prior assemblies, when the bottom rail is lowered from the top rail, the flexible sheet element is unfolded so as to form a blind or cover between the two rails. It will be understood however that where the flexible element has an overall length greater than the distance between the top rail 12 and the bottom rail there will remain a number of folds or pleats between the two rails even when fully opened. The weight of the flexible sheet element will have a tendency, however, to pull the top portion of the sheet element into a substantially linear or laminar fashion, with a greater number of pleats or folds occurring at the lower end of the sheet element. Such an arrangement is not aesthetically pleasing and detracts from the overall appearance of the blind assembly.

In the first embodiment, and in order to overcome this problem, a flexible strip-like connecting member 20, for example, a cord, string or ribbon, is arranged between the top rail 12 and the bottom rail 14, typically at least near each longitudinal edge of the blind. The cord 20 is attached to alternate fold lines 18 occurring on one side of the sheet element 16. This is shown in FIG. 1. Depending upon the width of the blind it may be necessary to include several spaced connecting members 20.

The cord 20 will be secured to that side of the sheet element 16 which is to be the least visible to the user, that is the "rear" face of the sheet element 16. Typically, this will be the face which is presented next to a door/window. The cord 20 is also attached to those alternate fold lines which project outwardly from the rear face of the blind (or inwardly with respect to the front face of the blind).

Attachment of the connecting member 20 to the sheet element 16 is preferably by way of a plurality of loops 22 attached at fixed positions and equidistantly spaced along the length of the connecting member 20. These loops are then engaged, for example, by use of a thread e.g. by sewing, or by a flexible plastic I-shaped element to alternate fold lines 18 on the sheet element 16. It will thus be appreciated that the maximum distance between alternate folds 18 is therefore constrained by the distance between the loops 22 on the cord 20.

Thus when the bottom rail 14 is displaced away from the top rail 12, and the flexible sheet element 16 is unfolded, the spacing between alternative fold lines is fixed. Thus the blind adopts an aesthetically pleasing configuration irrespective of the amount of displacement of bottom rail 14 in relation to the top rail 12.

In order to provide a unitary construction it is preferable to form the cord 20 and the loops 22 simultaneously by inserting the loops into the cord during its manufacturing process. As such cords 20 are commonly made of a plurality of fibres woven together the insertion of a number of loops 22 at predetermined spacings can easily be accomplished during the cord's manufacture. With such a construction it is relatively difficult for the loops to separate from the cord in use.

Figure 2:
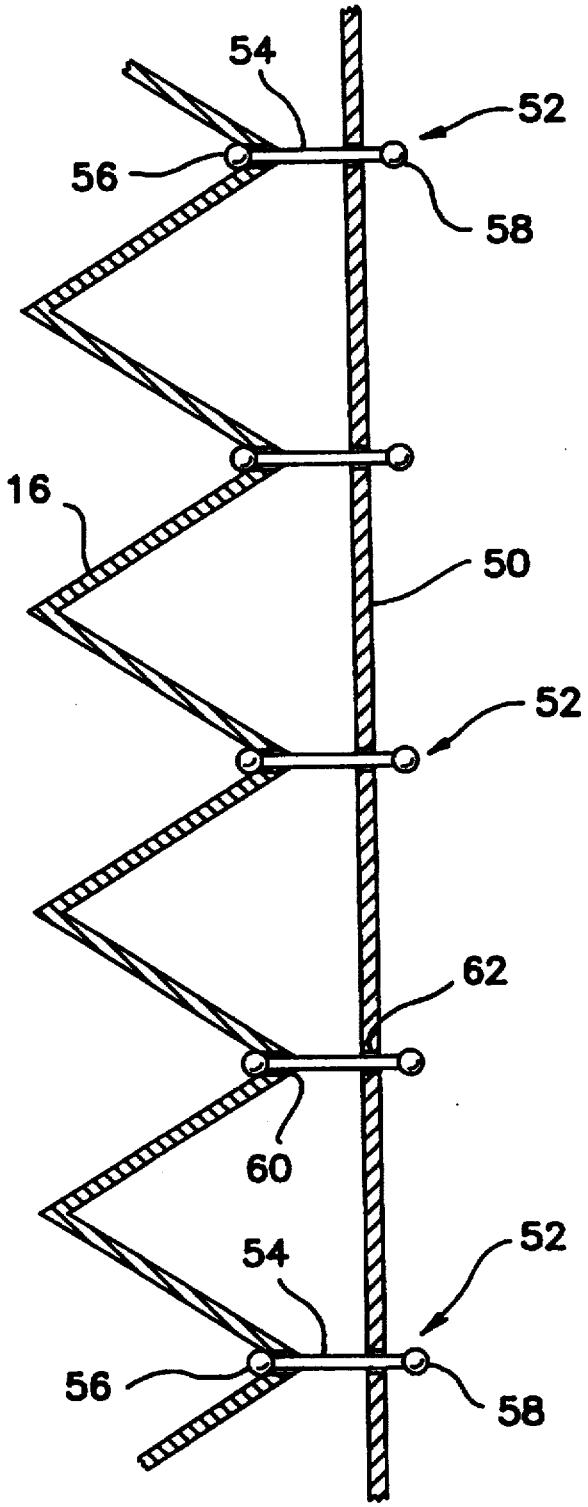
FIG. 2 is a sectional end view of a second preferred embodiment.

FIG. 2 shows a sectional view of a second and most preferred embodiment of the invention. In this embodiment the flexible connecting member is an elongate element such as a ribbon 50. The ribbon 50 is arranged to extend the length of the flexible sheet element 16 and is secured between the top and bottom rails of the blind. The ribbon 50 is attached to the flexible sheet element 16 by a plurality of submembers in the form of I-section tags. Tag 52 has a shank or centre section 54 and projections or cross pieces 56, 58 at each end thereof. The tags 52 are constructed from a generally transparent plastics material.

One end of each tag 52 is secured through a hole 60 in a fold line of the sheet element 16 and the other end of the tag engages a corresponding hole 62 in the ribbon 50. Tags 52 interconnect the ribbon and the sheet element at alternate fold lines as in the first embodiment. A tag 52 is typically secured to the sheet element 16 and ribbon 50 by deforming at least one cross piece 56, 58 so that it will pass through a hole 60 or 62, as appropriate. At least a cross piece 56, 58 of a tag 52 is constructed from a deformable material so that, once the cross piece 56, 58 has been inserted through the selected hole 60, 62 it extends to engage the sheet element 16 or ribbon 50 and thereby to resist its withdrawal through the holes.

The tags 52 may be secured to the sheet element 16 and ribbon 50 using apparatus of the type which will pierce the tags 52 and ribbon 50, compress or otherwise deform cross piece of the tag 52 and subsequently project the tag 52 so that the cross piece 56 passes through both the ribbon 50 and sheet element 16. The cross piece 56 subsequently extends to-prevent withdrawal of the tag 52. Examples of such apparatus, known as "tag guns" are employed in retail outlets for flexibly securing price tags and similar to articles.

The illustrated I-section tags 52 have been found to give very advantageous results. In particular, the shank or centre section 54 whilst providing some degree of "play" is also quite strong. As a result, undesirable sagging of the tag 52 and associated fold line 18 of the sheet element 16 is unlikely to occur.

It will be appreciated that, in the illustrated embodiment, cross piece 56 is accommodated adjacent a fold line of the flexible sheet element 16. In this way, the cross piece 56 need not be obtrusive. This can result in a particularly aesthetically pleasing effect. Particularly desirable results are obtainable by selecting a transparent material for the tags, or at least a cross piece.

The presence of the connecting member or ribbon 50 and I-section tags 52 may be further disguised by arranging the tags so that they engage the flexible sheet element generally in the path of a cord pull mechanism. Thus, in use, the flexible sheet element may be provided with a series of spaced apertures which communicate to define a passage for a cord or rod of a pull mechanism, when the cord/rod is threaded through the apertures at least some of the cord/rod is visible from either side of the flexible sheet element. Under these circumstances the flexible connecting member may be secured to one face of the sheet element (preferably whichever face is to be the least visible in use). The I-section tags are preferably secured to the flexible sheet element at locations shielded from view by the cord pull mechanism.

It will be appreciated that the present invention may be employed with pleated blinds made from a host of materials. For example, the flexible sheet element may be made of textile, plastic or paper. Also, the invention is not limited to blinds which are generally rectangular. Indeed, the present invention is particularly applicable to blinds of irregular or unusual shapes, such as circular or triangular.

I claim:

1. A pleated blind having:

two rails selectively displaceable towards one another and away from one another;

a flexible sheet element arranged between said two rails and having a plurality of fold lines arranged such that the flexible sheet element is partitioned into a plurality of contiguous parallel flat strips which are folded into pleats between the rails when the rails are disposed towards one another such that said strips are disposed in alternate first and second orientations; and at least one flexible connecting member disposed between said two rails, the flexible connecting member being flexibly secured to the flexible sheet element, substantially at alternate ones of said fold lines by a respective flexible connecting element, each connecting element being constituted by a discrete component connected to the connecting member and to the flexible sheet element, the connecting elements each being connected to the connecting member and substantially precluded from movement along the connecting member, said connecting member, when said rails are displaced away from one another, constraining said rails to a predetermined maximum spacing, and constraining said flexible sheet element such that substantially uniform pleats formed from adjacent, diverging and contiguous, flat strips are maintained between said alternate fold lines, adjacent strips being disposed at substantially equal but opposite angles about a median plane, which median plane is defined by and between the rails and parallel to the flexible connecting member.

2. A pleated blind according to claim 1 in which said flexible connecting member is disposed adjacent a rear surface of the blind.

3. A pleated blind according to claim 1 in which a respective flexible connecting element is provided at said each alternate ones of said fold lines there connecting the flexible connecting member to the flexible sheet member.

4. A pleated blind according to claim 1 in which, when said rails are displaced away from one another, said strips of the flexible sheet element define only a single thickness of material of the flexible sheet element.

5. A pleated blind having:

two rails selectively displaceable towards one another and away from one another;

a single thickness, flexible sheet element arranged between said two rails and having a plurality of fold lines arranged such that the flexible sheet element is partitioned into a plurality of contiguous, single thickness, parallel flat strips folded into pleats between the rails when the rails are disposed towards one another; and at least one flexible connecting member disposed between said two rails, the flexibly connecting member being flexibly secured to the flexible sheet element substantially at alternate ones of said fold lines by a respective flexible connecting element, each connecting element being constituted by a discrete component connected to the connecting member and to the flexible sheet element, the connecting elements each being connected to the connecting member and substantially precluded from movement along the connecting member, said connecting member, when said rails are displaced away from one another, constraining said rails to a predetermined maximum spacing, and constraining said flexible sheet element such that substantially uniform pleats of a single thickness of the flexible sheet element are formed and maintained between said alternate fold lines.

* * * * *

UNITED STATES PATENT AND TRADEMARK OFFICE

CERTIFICATE OF CORRECTION

PATENT NO. : 5,680,890

DATED : October 28, 1997

INVENTOR(S) : REGINALD C. ALLSOPP

It is certified that error appears in the above-indentified patent and that said Letters Patent is hereby corrected as shown below:

Column 8, line 10, "the flexibly connecting member" should read --the flexible connecting member--.

Signed and Sealed this

Sixth Day of January, 1998

*Attest:*

*Attesting Officer*

BRUCE LEHMAN

*Commissioner of Patents and Trademarks*